US005511999A

United States Patent [19]

Cochran et al.

[11] Patent Number: 5,511,999

[45] Date of Patent: Apr. 30, 1996

[54] FLIPPER

[76] Inventors: Andrew A. Cochran, 810 Oneawa St., Kailua, Hi. 96734; Scott B. Dillon, 3 Gaudrons Road, Coffs Harbour, New South Wales, Australia, 2450

[21] Appl. No.: 441,344

[22] Filed: May 15, 1995

[51] Int. Cl.[6] ..... A63B 31/12

[52] U.S. Cl. ..... 441/64

[58] Field of Search ..... 441/61–64

[56] References Cited

U.S. PATENT DOCUMENTS 2,423,571 7/1947 Wilen ..... 441/64
2,889,563 6/1959 Lamb et al. ..... 441/64
4,738,645 4/1988 Garofalo ..... 441/64
5,183,424 2/1993 Field ..... 441/64

*Primary Examiner*—Jesus D. Sotelo
*Attorney, Agent, or Firm*—Michael I. Kroll

[57] ABSTRACT

An improved flipper comprising a curved body having a foot pocket to receive a foot of a person therein. A shallow blade extends from a front end of the body. A heel strap is at a back end of the body to retain a heel of the foot of the person thereto. A dorsal fin extends outwardly from the body over the foot pocket. Propulsion, direction and diversion of water past the dorsal fin, will give directional guidance and stability to the person swimming in water.

5 Claims, 2 Drawing Sheets

Fig. 1
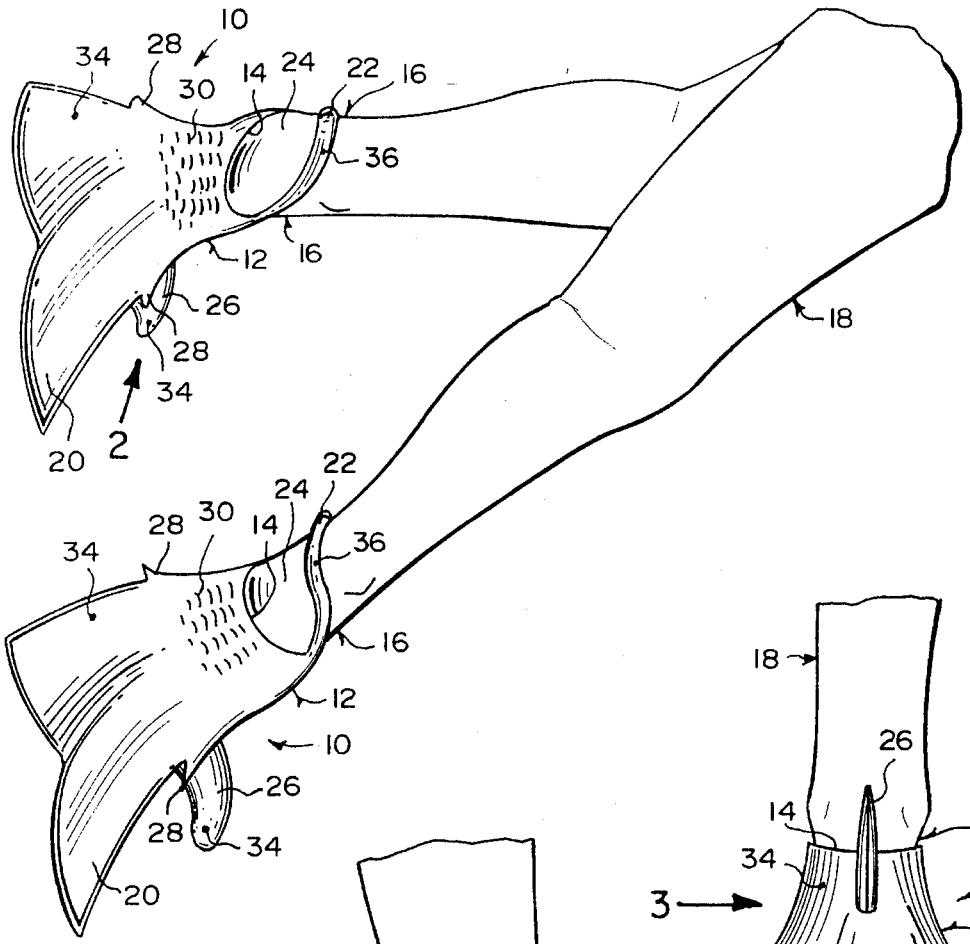
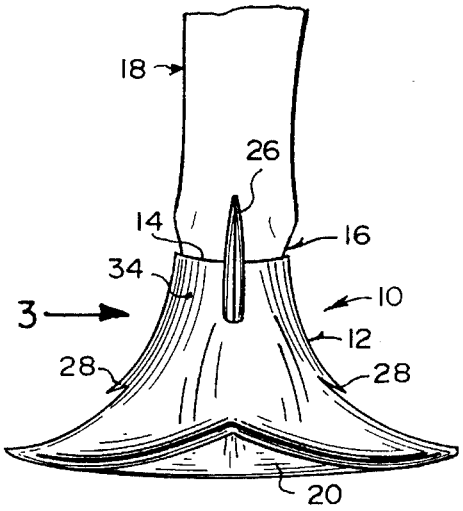
Fig. 2
Fig. 3
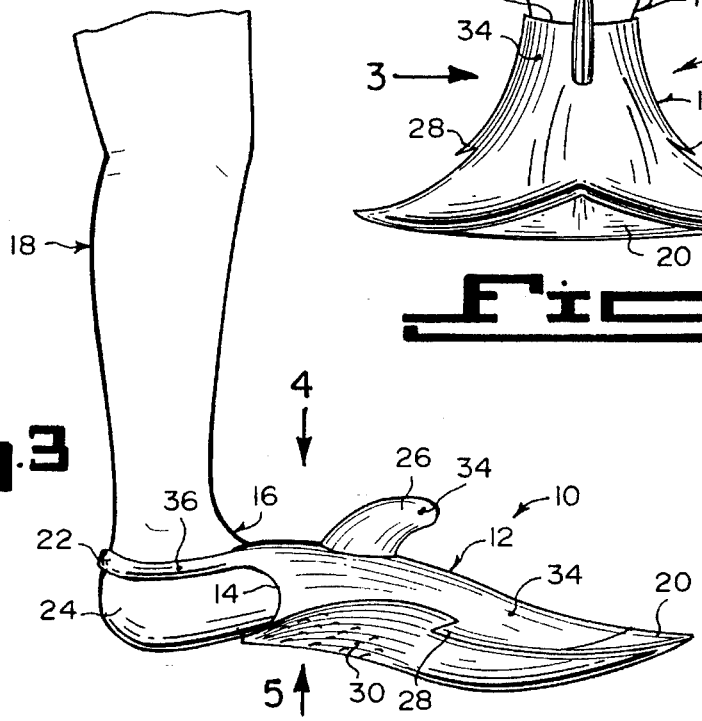

10
12
14
20
22
26
28
30
32
34
36
6
7

FLIPPER

BACKGROUND OF THE INVENTION

1. Field of the Invention

The instant invention relates generally to water sport equipment and more specifically it relates to an improved flipper.

2. Description of the Prior Art

Numerous water sport equipment have been provided in prior art that are adapted to be utilized to assist skin divers, swimmers, body surfers, boogie board riders and the like in the water. While these units may be suitable for the particular purpose to which they address, they would not be as suitable for the purposes of the present invention as heretofore described.

SUMMARY OF THE INVENTION

A primary object of the present invention is to provide an improved flipper that will overcome the shortcomings of the prior art devices.

Another object is to provide an improved flipper that will give directional guidance and stability to a person swimming in water, when a pair of the improved flippers are worn on the feet of the person.

An additional object is to provide an improved flipper that will allow for the propulsion, direction and diversion of water past a dorsal fin extending upwardly therefrom and will also direct, channel and divert water past side rail fins on outer edges thereof, to help make swimming effortless for the person.

A further object is to provide an improved flipper that is simple and easy to use.

A still further object is to provide an improved flipper that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein:

FIG. 1 is a side perspective view showing two legs of a person in a swimming position with the instant invention installed on two feet.

FIG. 2 is a front perspective view taken in the direction of arrow 2 in FIG. 1.

FIG. 3 is a right side view taken in the direction of arrow 3 in FIG. 2, showing the leg of the person in a standing position.

Similar reference characters denote corresponding features consistently throughout the attached drawings.

DETAILED DESCRIPTION OF THE PREFERRED EMBODIMENTS

Figures 4, 5, 6, 7, 8:
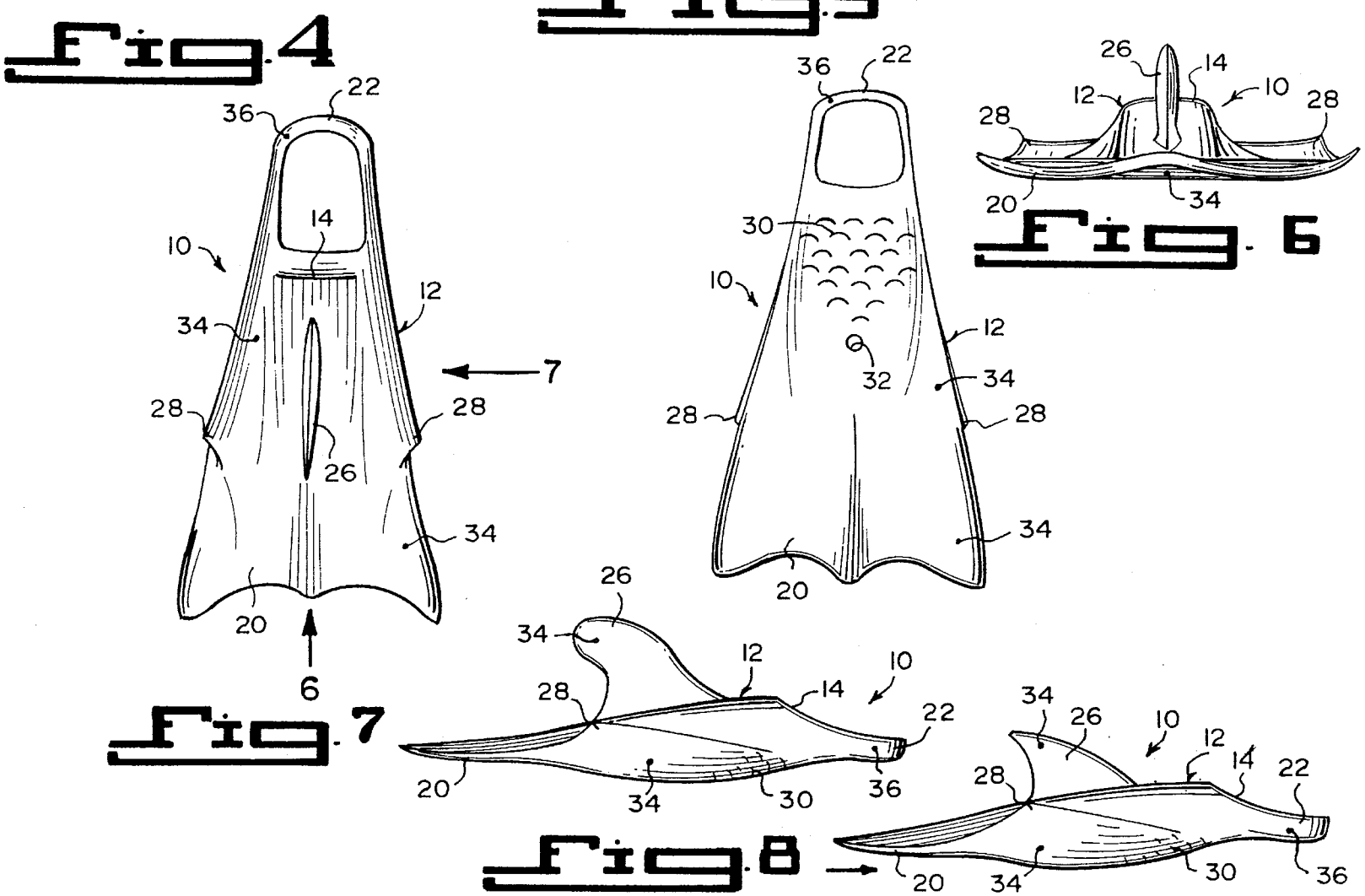
FIG. 4 is a top view of the instant invention per se taken in the direction of arrow 4 in FIG. 3.
FIG. 5 is a bottom view of the instant invention per se taken in the direction of arrow 5 in FIG. 3.
FIG. 6 is a front view taken in the direction of arrow 6 in FIG. 4.
FIG. 7 is a right side view taken in the direction of arrow 7 in FIG. 4.
FIG. 8 is a right side view similar to FIG. 7, showing a different shaped dorsal fin thereon.

Turning now descriptively to the drawings, in which similar reference characters denote similar elements throughout the several views, FIGS. 1 through 8 illustrate an improved flipper 10, comprising a curved body 12 having a foot pocket 14 to receive a foot 16 of a person 18 therein. A shallow blade 20 extends from a front end of the body 12. A heel strap 22 at a back end of the body 12 is to retain a heel 24 of the foot 16 of the person 18 thereto. A dorsal fin extends outwardly from the body 12 over the foot pocket 16. Propulsion, direction and diversion of water past the dorsal fin 26, will give directional guidance and stability to the person 18 swimming in water.

A pair of side rail fins 28 are also provided, with each located on an opposite outer edge of the body 12, the side rail fins 28 will direct, channel and divert water past the body 12, to help make swimming effortless for the person 18.

A bottom gripping surface 30 is located on the body 12, to prevent slippage on the ground when the person 18 is walking on dry land. The body 12, as shown in FIG. 5, can have a bottom drain hole 32, to help drain water out from the foot pocket 14 when the person 18 is walking on dry land.

The body 12 is made out of a physical substance 34 selected from the group consisting of rubber, silicon, plastic, any other man-made materials and any other natural materials. The shallow blade 20 is made out of the physical substance 34, which is selected from the group consisting of rubber, silicon, plastic, any other man-made materials and any other natural materials.

The dorsal fin 26 is made out of the physical substance 34, which is selected from the group consisting of rubber, silicon, plastic, any other man-made materials and any other natural materials. The heel strap 22 is made out of a stretchable material 36.

The side rail fins 28 are also made out of the physical substance 34 selected from the group consisting of rubber, silicon, plastic, any other man-made materials and any other natural materials. The body 12, the shallow blade 20, the dorsal fin 26, the heel strap 22 and the side rail fins 28 are integral, so as to form one complete whole unit.

The improved flipper 10 can be manufactured in various sizes to accommodate different individual foot sizes. Only one improved slipper 10 is described above but logically a pair are used in conjunction with both feet 16 of the person 18, as shown in FIG. 1, for swimming in the water.

A hole or holes (not shown) may be drilled or molded through the heel strap 22, to affix an ankle retention component to the heel strap 22 for securement to the ankle of the person 18. The shallow blade 20 may be made out of a softer more flexible material, to give flexibility thereto. The shallow blade 20 may also be made out of a harder material, to give more rigidity thereto.

The dorsal fin 26 can be made in different sizes and shapes as comparatively illustrated in FIG. 7 and 8, so as to suit different needs of the person 18 when swimming in the water. The bottom surface of the curved body 12 is lower than the shallow blade 20 and the heel strap 22, so as to provide a more comfortable fit for the foot 16 of the person 18 and stabilizes the improved flipper 10 when walking on dry land.

LIST OF REFERENCE NUMBERS

10 improved flipper
12 curved body
14 foot pocket in 12
16 foot of 18
18 person
20 shallow blade
22 heel strap
24 heel of 16
26 dorsal fin on 12
28 side rail fin on 12
30 bottom gripping surface on 12
32 bottom drain hole in 12
34 physical substance of 12, 20, 26, 28
36 stretchable material of 22

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. An improved flipper comprising;

a) a curved body having a foot pocket to receive a foot of a person therein;

b) a shallow blade extending from a front end of said body;

c) a heel strap at a back end of said body to retain a heel of the foot of the person thereto; and d) a dorsal fin having a base, said dorsal fin extending outwardly from said body, said base limited to the length of said foot pocket, whereby propulsion, direction and diversion of water past said dorsal fin, will give directional guidance and stability to the person swimming in water.

2. An improved flipper as recited in claim 1, further including a pair of outwardly and upwardly curved side rail fins, each located on an opposite outer edge of said body, whereby said side rail fins will direct, channel and divert water past said body to help make swimming effortless for the person.

3. An improved flipper as recited in claim 1, further including a bottom gripping surface located on said body, to prevent slippage on the ground when the person is walking on dry land. An improved flipper as recited in

4. An improved flipper as recited in claim 1, further including said body having a bottom drain hole to help drain water out from said foot pocket when the person is walking on dry land.

5. An improved flipper as recited in claim 1, wherein said heel strap is made out of a stretchable material.

* * * * *